US012115427B2

(12) United States Patent
El-Amin

(10) Patent No.: US 12,115,427 B2
(45) Date of Patent: Oct. 15, 2024

(54) BASKETBALL DRIBBLING TRAINING SYSTEM

(71) Applicant: Yahya El-Amin, Indianapolis, IN (US)

(72) Inventor: Yahya El-Amin, Indianapolis, IN (US)

( * ) Notice: Subject to any disclaimer, the term of this patent is extended or adjusted under 35 U.S.C. 154(b) by 192 days.

(21) Appl. No.: 17/902,853

(22) Filed: Sep. 4, 2022

(65) Prior Publication Data

US 2024/0075368 A1 Mar. 7, 2024

(51) Int. Cl.
*A63B 69/00* (2006.01)
*A63B 22/02* (2006.01)

(52) U.S. Cl.
CPC ..... *A63B 69/0071* (2013.01); *A63B 22/02* (2013.01); *A63B 2243/0037* (2013.01)

(58) Field of Classification Search
CPC ..... A63B 69/0071; A63B 22/02; A63B 2243/0037; A63B 21/0557; A63B 2209/00
USPC ..... 473/422; 482/8, 54, 121, 123, 126, 127, 482/131
See application file for complete search history.

(56) References Cited

U.S. PATENT DOCUMENTS 4,227,487 A 10/1980 Davis
4,903,614 A * 2/1990 Johnson ..... A47B 3/08 108/19
5,050,861 A * 9/1991 Thomas ..... A63B 23/0458 482/52
D332,647 S 1/1993 Johnson
6,245,001 B1 * 6/2001 Siaperas ..... A63B 21/0552 482/142
7,311,642 B2 * 12/2007 Li ..... A63B 23/0458 482/142
7,614,991 B2 * 11/2009 Fox ..... A63B 69/0064 482/52
8,657,727 B1 * 2/2014 Kassel ..... A63B 21/0552 482/121
8,900,074 B1 * 12/2014 Johnson ..... A63B 63/00 473/422
9,265,228 B2 * 2/2016 Burton ..... A01D 34/00
D755,910 S 5/2016 Randazzo
9,480,870 B2 11/2016 Januszek
9,737,138 B1 * 8/2017 Siebert ..... A63B 22/02
2006/0097123 A1 * 5/2006 Gallien ..... A47B 97/00 248/500
2010/0011543 A1 * 1/2010 Wang ..... F16G 11/103 24/300
2014/0080678 A1 * 3/2014 Wu ..... A63B 22/02 482/54
2014/0360413 A1 * 12/2014 Schenk ..... A47B 87/002 108/50.11

(Continued)

FOREIGN PATENT DOCUMENTS

EP 2907549 2/2015

*Primary Examiner* — Nini F Legesse

(57) ABSTRACT

A basketball dribbling training system for training a user to dribble a basketball while in motion includes a treadmill including a frame having a side edge, wherein a continuous belt is positioned on the frame. A platform has a top surface, and a vertical support is attached to and extends downwardly from the platform. The vertical support positions the platform above an upper surface of the frame, wherein the platform extends over the frame adjacent to the side edge. A connector releasably couples the vertical support to the treadmill to retain the vertical support in abutment with the treadmill such that the platform extends over the frame.

8 Claims, 4 Drawing Sheets

(56) References Cited

U.S. PATENT DOCUMENTS

| | | | |
|---|---|---|---|
| 2021/0162258 | A1 | 6/2021 | Manson |
| 2021/0228961 | A1 | 7/2021 | Cannon |

* cited by examiner

BASKETBALL DRIBBLING TRAINING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to basketball training systems and more particularly pertains to a new basketball training system for training a user to dribble a basketball while in motion.

(2) Description of Related Art Including Information Disclosed Under 37 CFR 1.97 and 1.98

The prior art relates to basketball training systems and devices. The most pertinent device in the prior art is disclosed in U.S. Pat. App. No. 2021/0228961 A1, which describes a device that provides a panel to dribble a basketball underneath. However, the prior art does not disclose a system which secures a platform laterally to a treadmill for dribbling the basketball while walking or running on the treadmill.

BRIEF SUMMARY OF THE INVENTION

An embodiment of the disclosure meets the needs presented above by generally comprising a treadmill including a frame having a side edge, wherein a continuous belt is positioned on the frame. A platform has a top surface, and a vertical support is attached to and extends downwardly from the platform. The vertical support positions the platform above an upper surface of the frame, wherein the platform extends over the frame adjacent to the side edge. A connector releasably couples the vertical support to the treadmill to retain the vertical support in abutment with the treadmill such that the platform extends over the frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
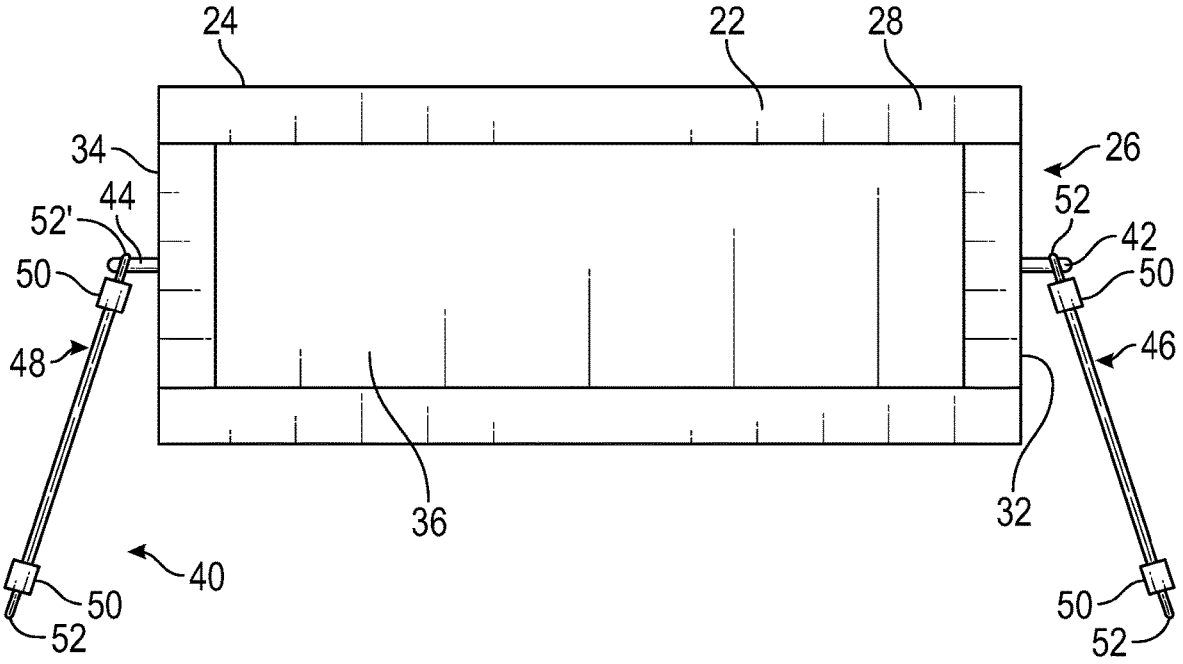
FIG. 1 is a back view of a platform, vertical support, and connector of a basketball dribbling training system according to an embodiment of the disclosure.
Figure 2:
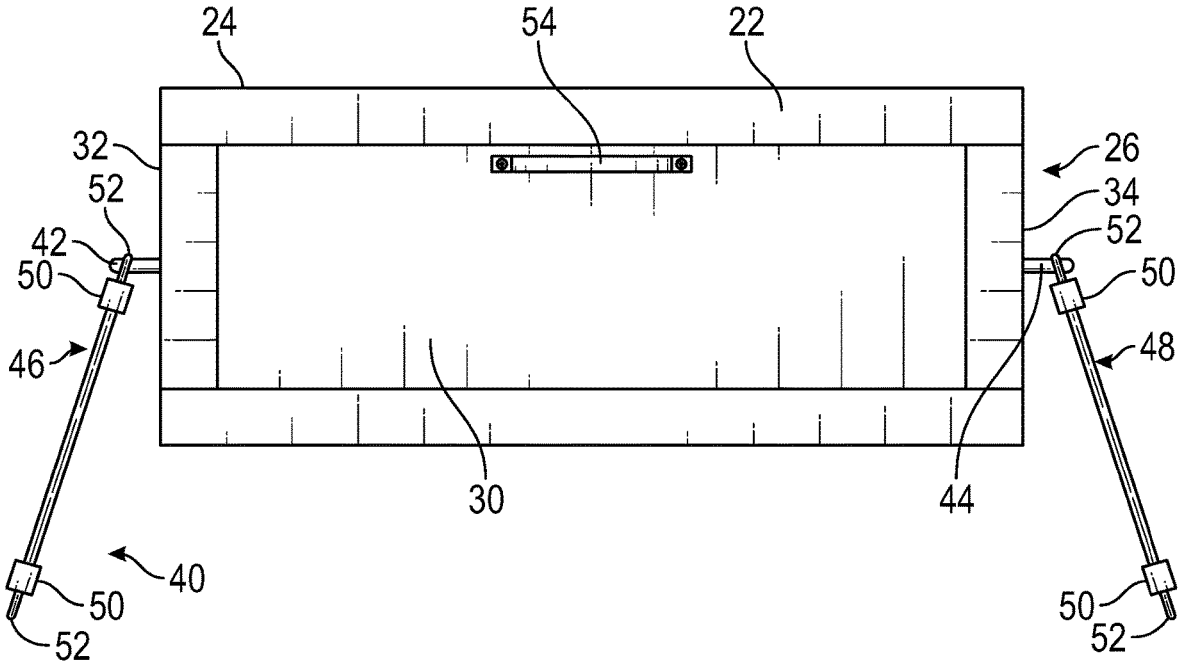
FIG. 2 is a front view of a platform, vertical support, and connector of an embodiment of the disclosure.
Figure 3:
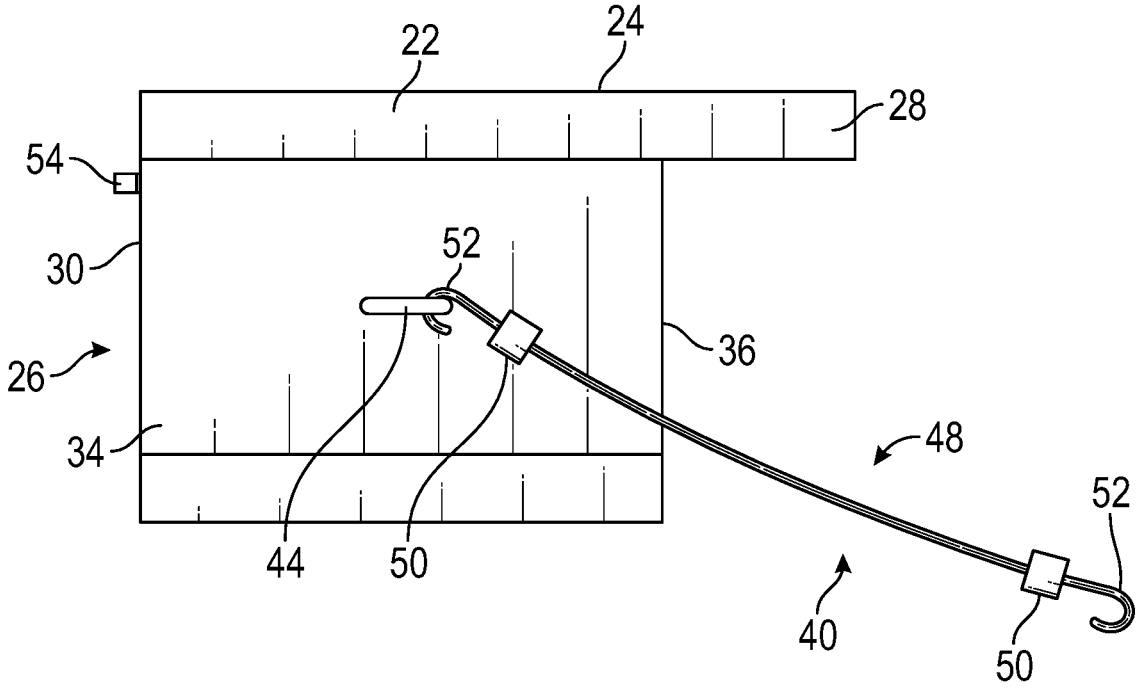
FIG. 3 is a side view of a platform, vertical support, and connector of an embodiment of the disclosure.
Figure 4:
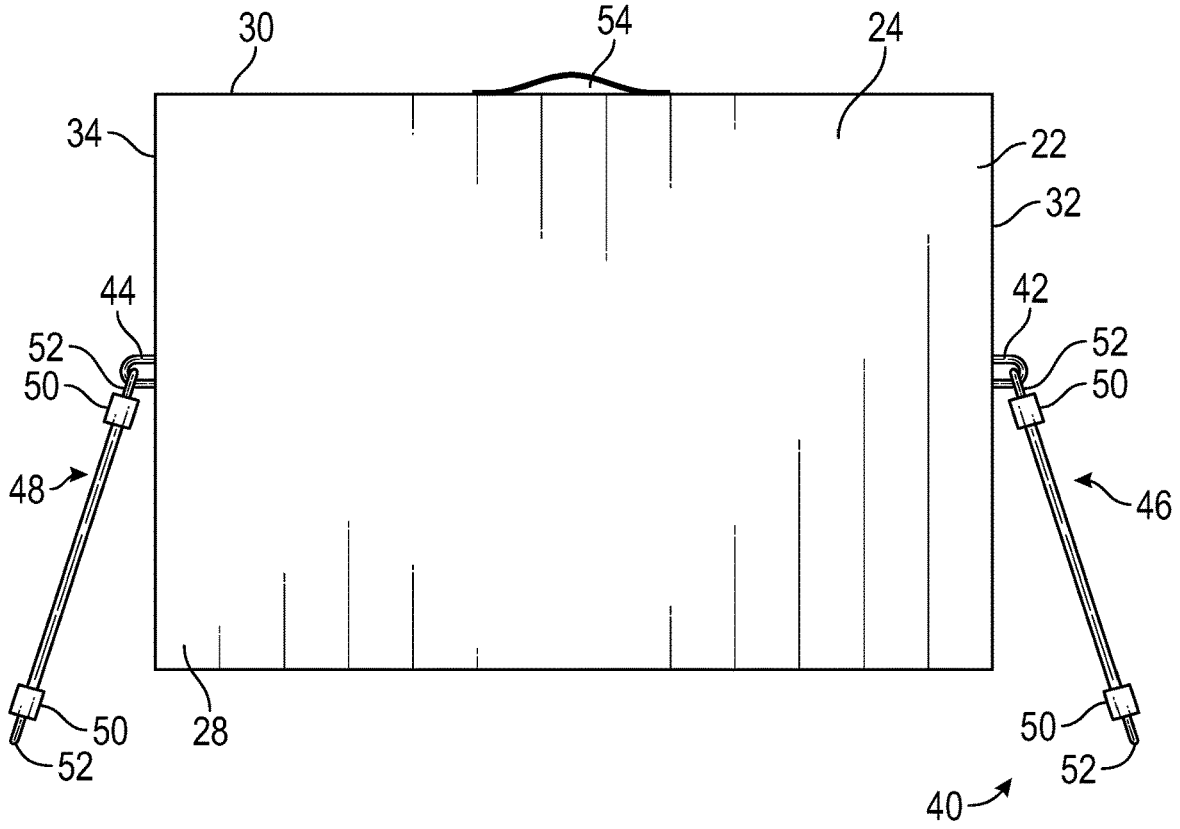
FIG. 4 is a top view of a platform, vertical support, and connector of an embodiment of the disclosure.
Figure 5:
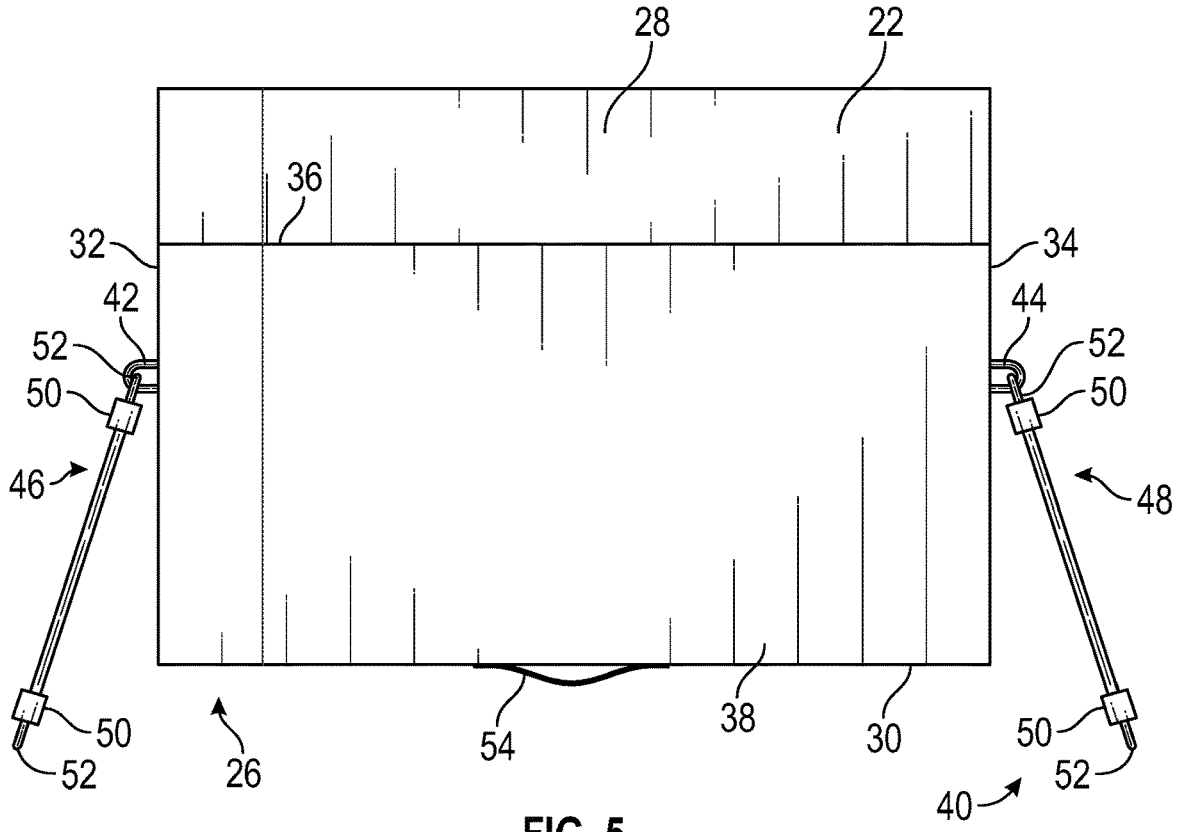
FIG. 5 is a bottom view of a platform, vertical support, and connector of an embodiment of the disclosure.
Figure 6:
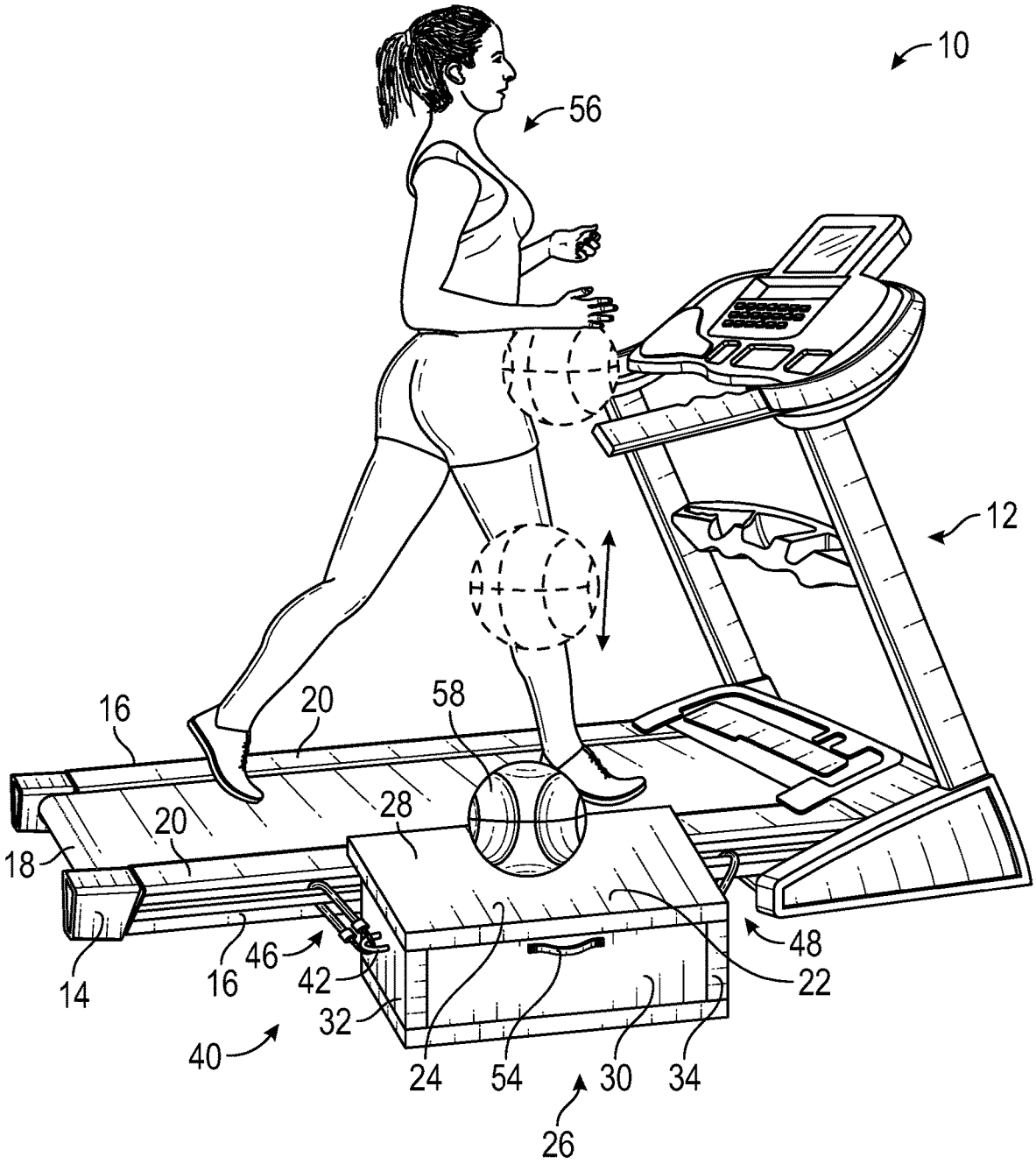
FIG. 6 is an in-use view of an embodiment of the disclosure.

With reference now to the drawings, and in particular to FIGS. 1 through 6 thereof, a new basketball training system embodying the principles and concepts of an embodiment of the disclosure and generally designated by the reference numeral 10 will be described.

As best illustrated in FIGS. 1 through 6, the basketball dribbling training system 10 generally comprises a treadmill 12 including a frame 14 having a side edge 16. A continuous belt 18 is positioned on the frame 14. Generally, the treadmill is of conventional construction. A platform 22 has a top surface 24. The top surface has a length between 20.0 inches and 28.0 inches, and a width between 12.0 inches and 20.0 inches. The length is aligned with the side edge 16 of the treadmill 12 as shown in the Figures. A vertical support 26 is attached to and extends downwardly from the platform 22 which positions the platform 22 above an upper surface 20 of the frame 14. More particularly, the platform is positioned to extend over the frame 14 adjacent to the side edge 16 for reasons described below. The platform 22 extends rearwardly from the vertical support 26 a distance between 4.0 inches and 12.0 inches to define a flange 28 extending over the frame 14. The vertical support 26 has a height between 6.0 inches and 12.0 inches. The vertical support 26 may include a front wall 30, a first lateral wall 32, a second lateral wall 34, a rear wall 36, and a bottom wall 38 for stability purposes, however only a pair of oppositely positioned walls may be used.

A connector 40 releasably couples the vertical support 26 to the treadmill 12 to retain the vertical support 26 in abutment with the treadmill 12 and such that the platform 22 extends over the frame 14. The connector 40 may include a first anchor 42 being attached to the first lateral wall 32 and a second anchor 44 being attached to the second lateral wall 34. In one embodiment, each of the first anchor 42 and the second anchor 44 comprises a closed loop. Tethers are used to secure the first 42 and second 44 anchors to the treadmill 12. More particularly, a first tether 46 and a second tether 48 may be provided wherein first tether 46 is attached to the first anchor 42 and the side edge 16, and the second tether 48 is attached to the second anchor 44 and the side edge 16. Each of the first tether 46 and the second tether 48 is resiliently stretchable and includes a pair of ends 50 comprising hooks 52 for engaging a corresponding one of the first anchor 42 and the second anchor 44. A handle 54 may be coupled to the vertical support 26 to facilitate transporting of the platform 22. The handle will typically be positioned on the front wall 30.

In use, the platform 22 is positioned such that it extends over the frame 14 adjacent to the side edge 16. The side edge 16 may be one of a pair of opposing side edges 16, wherein the platform 22 is positioned to over either side edge 16. Once in this position, the vertical support 26 is releasably coupled to the treadmill 12 via the connector 40 such that the platform 22 is held securely in place. In this configuration, the system 10 may be used to train a user 56 in dribbling a basketball, whereby the user 56 runs or walks on the continuous belt 18 of the treadmill 12 while dribbling a basketball 58 on the top surface 24 of the platform 22. The flange 28 prevents the basketball from hitting a corner of the side edge 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A basketball dribbling training system comprising:

a treadmill including a frame, a continuous belt being positioned on said frame, an upper surface of said frame being substantially aligned with an uppermost surface of said continuous belt;

a platform having a top surface, said platform being positioned adjacently above said upper surface of said frame, said platform extending over said frame adjacent to a side portion of said frame;

a vertical support being attached to and extending downwardly from said platform; and a connector releasably coupling said vertical support to said treadmill to retain said vertical support in abutment with said treadmill such that said platform extends over said frame.

2. The system of claim 1, further comprising said platform extending rearwardly from said vertical support to define an overhang extending over said frame.

3. The system of claim 1, further comprising said connector including:

a first anchor being attached to a first lateral wall of said vertical support and a second anchor being attached to a second lateral wall of said vertical support, each of said first and second anchors comprising a closed loop; and a first tether being attached to said first anchor and said side portion, a second tether being attached to said second anchor and said side portion.

4. The system of claim 3, further comprising each of said first and second tethers being resiliently stretchable.

5. The system of claim 3, further comprising each of said first and second tethers each having a pair of ends comprising hooks for engaging a corresponding one of said first and second anchors.

6. The system of claim 1, further comprising a handle being coupled to said vertical support, said handle extending away from said vertical support and defining a gap between said handle and said vertical support, said handle being positioned on a front wall of said vertical support.

7. A basketball dribbling training system comprising:

a treadmill including a frame, a continuous belt being positioned on said frame, an upper surface of said frame being substantially aligned with an uppermost surface of said continuous belt, said treadmill comprising a rail which is coupled to and extends along a side portion of said frame;

a platform having a top surface, said platform being positioned adjacently above said upper surface of said frame, said platform extending over said side portion of said frame;

a vertical support being attached to and extending downwardly from said platform, said platform extending rearwardly from said vertical support to define an overhang extending over said frame;

said vertical support including a front wall, a first lateral wall, a second lateral wall, a rear wall, and a bottom wall;

a connector releasably coupling said vertical support to said treadmill to retain said vertical support in abutment with said treadmill such that said platform extends over said frame, said connector including:

a first anchor being attached to said first lateral wall and a second anchor being attached to said second lateral wall, each of said first and second anchors comprising a closed loop;

a first tether being attached to said first anchor and said side portion via said rail, a second tether being attached to said second anchor and said side portion via said rail, each of said first and second tethers being resiliently stretchable, each of said first and second tethers each having a pair of ends comprising hooks which engage a corresponding one of said first and second anchors, each of said first and second tethers looping around said rail of said treadmill to couple said vertical support to said treadmill;

a handle being coupled to said vertical support, said handle extending away from said vertical support and defining a gap between said handle and said vertical support, said handle being positioned on said front wall.

8. The system of claim 3, wherein:

said treadmill further comprises a rail which is coupled to and extends along said side portion of said frame; and said first and second tethers loop around said rail of said treadmill to couple said vertical support to said treadmill.

* * * * *